United States Patent [19]

Gruber et al.

[11] Patent Number: 4,879,199

[45] Date of Patent: Nov. 7, 1989

[54] PROCESS FOR PREPARING ENCAPSULATED COLOR TONER COMPOSITIONS

[75] Inventors: Robert J. Gruber, Pittsford; Raymond A. Yourd, III, Rochester; Paul C. Julien, West Webster; John F. Knapp, Fairport; Steven B. Bolte, Rochester, all, N.Y.

[73] Assignee: Xerox Corporation, Stamford, Conn.

[21] Appl. No.: 262,249

[22] Filed: Oct. 20, 1988

Related U.S. Application Data

[63] Continuation of Ser. No. 764,023, Aug. 9, 1985, abandoned.

[51] Int. Cl.[4] ..... G03G 9/08

[52] U.S. Cl. ..... 430/137; 430/138

[58] Field of Search ..... 430/137, 138

[56] References Cited

U.S. PATENT DOCUMENTS

| | | | |
|---|---|---|---|
| 4,426,436 | 1/1984 | Lewis et al. | 430/137 |
| 4,451,837 | 5/1984 | Gruber et al. | 346/153.1 |
| 4,487,825 | 12/1984 | Gruber et al. | 430/106.6 |
| 4,545,669 | 10/1985 | Hays et al. | 355/3 R |
| 4,569,896 | 2/1986 | Perez et al. | 430/106.6 |

*Primary Examiner*—Roland E. Martin

*Attorney, Agent, or Firm*—Judith L. Byorick; Eugene O. Palazzo

[57] ABSTRACT

Disclosed is an improved stable colored toner composition comprised of resin particles, colloidal silica additive particles, and colored pigment particles; and wherein each of the toners are encapsulated in a continuous shell from about 1 to about 30 percent by weight of a waxy substance with a molecular weight of from about 500 to about 20,000.

24 Claims, 1 Drawing Sheet

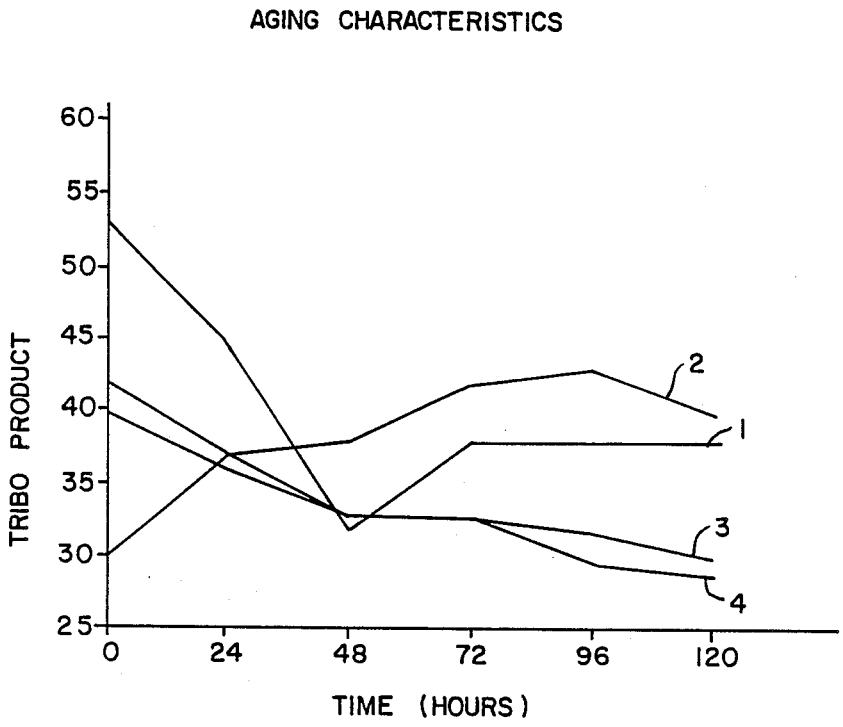
AGING CHARACTERISTICS
TRIBO PRODUCT
60
55
50
45
40
35
30
25
0
24
48
72
96
120
TIME (HOURS)
1
2
3
4

PROCESS FOR PREPARING ENCAPSULATED COLOR TONER COMPOSITIONS

This is a continuation of application Ser. No. 764,023 filed Aug. 9, 1985, now abandoned.

BACKGROUND OF THE INVENTION

This invention is generally directed to toner and developer compositions. More specifically, the present invention is directed to a process for preparing colored toner compositions wherein each of the selected pigments are encapsulated with a continuous shell of a low molecular weight waxy compound, inclusive of polyethylene or polypropylene. Thus, in one embodiment of the present invention there is provided a toner composition encapsulated with a substantially continuous shell of a polyethylene or polypropylene wax of molecular weight of from about 1,000 to about 6,000, and comprised of resin particles, and colored pigment particles. The encapsulation enables the resulting toner compositions to possess substantially identical charging characteristics, and decreased aging over extended time periods. Accordingly, the toner and developer compositions of the present invention are useful in permitting the development of colored images in electrophotographic imaging and printing processes. Specifically, thus the toner compositions illustrated herein can be selected for use in generating colored images while retaining stable triboelectric electrical characteristics. Furthermore, in accordance with the present invention there are provided toner and developer compositions wherein each of the separate colored toner particles, inclusive of cyan, magenta, and yellow age at substantially the same rate permitting developed prints with the same color intensity beginning with the first printing or imaging cycle and continuing on for an extended number of cycles.

Toner and developer compositions with waxy materials are known. Thus, for example, there is described in British Pat. No. 1,442,835 a toner composition with a styrene homopolymer or copolymer resin, and at least one polyalkylene compound selected from polyethylene and polypropylene. According to the disclosure of this patent, reference page 2, beginning at line 90, the starting polymer resin may be either a homopolymer of styrene, or a copolymer of styrene with other ethylenically unsatured monomers, specific examples of which are disclosed on page 3, beginning at line 1. Polyalkylene compounds selected for incorporation into the toner compositions disclosed in this patent include polyethylenes and polypropylenes of an average molecular weight of from about 2,000 to about 6,000.

Additionally, there is disclosed in U.S. Pat. No. 4,460,672 a developer composition mixture comprised of electrostatic toner particles consisting of resin particles, pigment particles, a waxy material with a molecular weight of from about 500 to about 20,000; and further included in the composition from about 0.5 percent by weight to about 10 percent by weight of a charge enhancing additive selected from, for example, alkyl pyridinium halides, organic sulfonate compositions, and organic sulfate compositions. The disclosure of this patent is totally incorporated herein by reference.

Also, there is disclosed in U.S. Pat. No. 4,206,247 a developer composition with a mixture of resins including a low molecular weight polyolefin and alkyl modified phenol resins. More specifically, is it indicated in this patent, reference column 4, line 6, that the invention is directed to a process which comprises the steps of developing an image with toner particles containing in certain proportions at least one resin selected from group A, at least one resin selected from the group B resins, wherein the resins of group A include a low molecular weight polyethylene; a low molecular weight polypropylene; and similar materials; and wherein the group B resins include natural resin modified maleic acid resins, natural modified pentaerythritol resins, and other resins. As examples of group A resins there is mentioned polystyrene, styrene series copolymers, polyesters, epoxy resins, and the like, reference the disclosure in column 5, line 47. The molecular weight of the polypropylene, or polyethylene used is from about 1,000 to about 10,000, and preferably from about 1,000 to 5,000.

Furthermore, there is described in a copending application, U.S. Ser. No. 655,381, now U.S. Pat. No. 4,556,624, entitled Toner Compositions with Crosslinked Resins and Low Molecular Weight Wax, the disclosure of which is totally incorporated herein by reference, toner compositions comprised of crosslinked copolymer resins including styrene alkyl methacrylates crosslinked with, for example, divinylbenzene or a polyblend mixture of these crosslinked copolymer resins with a second polymer, including styrene butadiene copolymer resins; pigment particles; a low molecular weight waxy composition selected from the group consisting of polyethylene and polypropylene; and as optional components charge enhancing additives selected from the group consisting of alkyl pyridinium halides, and organic sulfonate compounds.

Other representative prior art includes U.S. Pat. Nos. 4,187,194 and 3,788,994, which disclose encapsulation processes wherein the liquid or pressure fixable toner particles selected may be protected by a low molecular weight. polyethylene. Patents of background interest and located as a result of a patentability search include 4,206,247 and 4,418,137 wherein combinations of resins are selected for formulating toner compositions including low molecular weight polypropylenes; 4,002,776; 4,254,201; 4,262,076; 4,293,632; and 4,379,825. The aforementioned patents relate generally to encapsulation and/or the use of polypropylene in toner compositions.

Additionally, the Xerox Corporation 6500® copying machine selects separate toner compositions, inclusive of a magneta toner composition, a cyan toner composition, and a yellow toner composition. It is known that in some instances with the 6500® images of poor copy quality result. Thus, these images have undesirable background deposits, and low densities unless the bias on the developer mixtures is adjusted, resulting from different triboelectric charging properties as each of the colored toner compositions age. This problem is eliminated with the toner compositions of the present invention in that there can be achieved substantially similar stable triboelectric charging characteristics for the colored toner compositions primarily as a result of the presence of a shell of the low molecular weight waxy compound present on the surface of the toner pigment particles. Moreover, with the toner composition of the present invention it may be unnecessary to select toner particles of a different composition as is the situation with many of the prior art developers. Furthermore, only a limited number of useful colored pigments are available, therefore, substantial efforts have been consumed in affecting adjustments to the aforementioned colored toner compositions for enabling improved copy quality with extended usage.

Accordingly, there continues to be a need for toner compositions with improved electrical stability. There is also a need for colored toner compositions wherein each of the separate toners generated are of substantially equal triboelectric charging values. Further, there is a need for colored toner compositions wherein the resulting separate toners generated do not significantly age with an extended number of copy cycles. Additionally, there is a need for magenta, cyan, yellow; highlight colors such as red, blue, and green; toner compositions with similar triboelectric charging characteristics; and wherein these characteristics are maintained for an extended number of imaging cycles. There is also a need for colored toner compositions with improved stable electrical properties thereby enabling substantially similar color intensities for an extended number of imaging cycles.

SUMMARY OF THE INVENTION

It is an object of the present invention to provide colored toner compositions which overcome many of the above-noted disadvantages.

In another object of the present invention there are provided colored toner compositions with pigments encapsulated within a low molecular weight waxy compound.

In still another object of the present invention there are provided different colored toner compositions with relatively equivalent electrical characteristics for an extended number of imaging cycles in xerographic printing and xerographic imaging processes.

In yet another object of the present invention there are provided magenta toner compositions that maintain their triboelectric charging values for an extended number of imaging cycles in xerographic printing, and xerographic imaging processes; and wherein these compositions are encapsulated in a continuous shell of a low molecular weight waxy compound.

In yet a further object of the present invention there are provided cyan toner compositions that maintain their triboelectric charging values for an extended number of imaging cycles in xerographic printing, and xerographic imaging processes; and wherein these compositions are encapsulated in a continuous shell of a low molecular weight waxy compound.

In yet a further object of the present invention there are provided yellow toner compositions that maintain their triboelectric charging values for an extended number of imaging cycles in xerographic printing, and xerographic imaging processes; and wherein these compositions are encapsulated in a continuous shell of a low molecular weight waxy compound.

It is an additional object of the present invention to provide colored electrostatic latent imaging processes with colored toners encapsulated in a continuous shell of a low molecular weight waxy compound.

In a further object of the present invention there are provided colored printing processes with separate toner compositions encapsulated in a continuous shell of a low molecular weight waxy compound.

These and other objects of the present invention are accomplished by providing colored toner, and developer compositions. More specifically, in accordance with the present invention there are provided toner compositions comprised of resin particles, colored pigment particles and encapsulating compounds with low surface tension and low melt viscosities comprised of, for example, low molecular weight waxy substances. Thus, in one embodiment of the present invention there is provided colored toner compositions comprised of toner resin particles, a colorant selected from the group consisting of cyan, magenta, yellow, red, green, brown, or mixtures thereof; and an encapsulating continuous shell thereover of a low molecular weight waxy compound. Accordingly, in accordance with the present invention in a specific embodiment there is provided separate colored toner compositions each of which is comprised of toner resin particles, a colorant, and an encapsulating continuous waxy shell thereover.

There are also provided, in accordance with the present invention, processes for permitting the development of electrostatic latent images which comprises formulating the aforementioned image on a photoconductive member followed by the development thereof with the toner compositions illustrated herein. Additionally, the toner compositions of the present invention may be useful for enabling the achievement of colored images in known printing processes. Subsequent to development, the images can be transferred to a suitable substrate such as paper, followed by fixing thereto with heat or other similar fixing processes.

Illustrative examples of resins useful for each of the toner compositions of the present invention include polyesters, styrene/butadienes, styrene copolymers such as styrene/methacrylate resins; polyamides, epoxies, polyurethanes, vinyl resins and polymeric esterification products of a dicarboxylic acid and a diol comprising a diphenol. Suitable vinyl resins include homopolymers or copolymers of two or more vinyl monomers. Examples of vinyl monomeric units are styrene, p-chlorostyrene, ethylenically unsaturated mono-olefins such as ethylene, propylene, butylene and isobutylene; vinyl esters such as vinyl acetate; esters of alphamethylene aliphatic monocarboxylic acids inclusive of methyl acrylate, ethyl acrylate and butyl methacrylate; acrylonitrile, methacrylonitrile, and acrylamine; and vinyl ethers such as vinyl methyl ether, vinyl isobutyl ether. Also, there can be selected as toner resins styrene butadienes with a high percentages of styrene, reference U.S. Pat. No. 4,469,770, the disclosure of which is totally incorporated herein by reference; and mixtures thereof.

Preferred resins for the toners of the present invention are polystyrene methacrylates, styrene butadienes, polyester resins such as those described in U.S. Pat. Nos. 3,655,374 and 3,590,000, the disclosures of which are totally incorporated herein by reference; polyester resins resulting from the condensation of dimethylterephthalate, 1,3 butanediol, and pentaerythritol, and Pliolite resins which are commercially available from Goodyear Corporation as S5A. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent.

Illustrative examples of magenta, cyan and yellow pigments, or colorants selected for the toner compositions of the present invention are well known, including for example the magenta compounds 2,9-dimethyl-substituted quinacridone, an anthraquinone dye identified in the color index as C1 60710; Hostaperm Pink; C1 Dispersed Red 15, a diazo dye identified in the color index as C1 16050; C1 Solvent Red 19; and the like. Examples of cyan materials that may be used as pigments include copper tetra-4(octadecyl sulfonamido) phthalocyanine; X-copper phthalocyanine pigment, listed in the color index as C1 74160; C1 Pigment Blue; Sudan Blue; and Anthrathrene Blue, identified in the color index as C1 69810; Special Blue X-2137; and the like; while illustrative examples of yellow pigments that may be selected include diarylide yellow 3,3-dichlorobenzidene acetoacetanilides; a monazo pigment identified in the color index as C1 12700; C1 Solvent Yellow 16, a nitrophenyl amine sulfonamide identified in the color index as Foron Yellow Se/GLN; C1 Dispersed Yellow 33; 2,5-dimethoxy-4-sulfonanilide phenylazo-4'-chloro-2,5-dimethoxy aceto-acetanilide; and Permanent Yellow FGL. These pigments are generally present in the toner composition in an amount of from about 2 weight percent to about 15 weight percent based on the weight of the toner resin particles.

Waxy substances, generally of a molecular weight of from about 500 to about 20,000, and preferably of a molecular weight of from about 1,000 to about 6,000 selected as the encapsulating shell for the colored toner compositions of the present invention are polyethylenes commercially available from Allied Chemical and Petrolite Corporation, Epolene N-15, commercially available from Eastman Chemical Products Incorporated; Viscol 550P, a low molecular weight polypropylene available from Sanyo Kasei K.K.; and similar materials. The commercially available polyethylenes selected have a molecular weight of from about 1,000 to 1,500 while the commercially available polypropylenes are of a molecular weight of about 4,000. Many of the polyethylene and polypropylene compositions useful in the present invention are illustrated in British Pat. No. 1,442,835, the disclosure of which is totally incorporated herein by reference.

The low molecular weight wax materials which are formulated into a shell by, for example known heat spheroidization processes, are present in various amounts; however, generally these waxes are present as the shell in an amount of from about 1 percent by weight to about 30 percent by weight, and preferably in an amount of from about 10 percent by weight to about 20 percent by weight. This shell, which is present in a thickness of from about 0.25 micron to about 1 micron, enables each of the individually prepared colored toner compositions to possess substantially equivalent triboelectric charging characteristics.

Also, incorporated into the toner compositions of the present invention are various additives including flow aid additives, such as colloidal silicas, reference U.S. Pat. Nos. 3,720,617 and 3,900,588, the disclosure of each of these patents being totally incorporated herein by reference. Generally from about 0.1 percent by weight to about 1 percent by weight, and preferably about 0.65 percent by weight of silica such as Aerosil R972, is incorporated into each of the colored toner compositions of the present invention.

As optional additives there can be selected for incorporation into the colored toner compositions of the present invention metal salts of fatty acids, inclusive of zinc stearate, reference U.S. Pat. No. 3,983,045, the disclosure of which is totally incorporated herein by reference. These metal salts are generally incorporated in an amount of from about 0.1 percent by weight to about 1 percent by weight, and preferably in an amount of 0.35 percent by weight.

Formulation of developers requires admixing with the aforementioned toner compositions carrier particles that will enable the toner particles to become positively charged. Accordingly, as carrier cores there can be selected steel, nickel, iron ferrites and the like, with coatings thereover of fluoropolymers, such as polyvinylidene fluoride, copolymers of tetrafluoroethylenes and vinyl chloride. Additionally, there can be selected nickel berry carriers as described in U.S. Pat. Nos. 3,847,604 and 3,767,598, the disclosures of which are totally incorporated herein by reference. The diameter of the coated carrier particles is from about 50 microns to about 1,000 microns, thus permitting the carrier particles to possess sufficient density and inertia to avoid adherence to the electrostatic images during the development process.

The carrier particles are mixed with the toner composition in various suitable combinations, however, best results are obtained with from about 1 part by weight of toner particles to about 3 parts by weight of toner particles, to about 100 parts to 200 parts by weight of carrier particles.

The toner triboelectric product (toner concentration multiplied by the toner tribo in microcoulombs per gram) is dependent, for example, on the components contained therein; and the carrier particles selected. Generally, however, the toner tribo product can be from about a negative or positive 30 to a negative or positive 90.

Examples of imaging members that may be selected for use with the toner and developer compositions of the present invention include various known photoreceptors, such as selenium; selenium alloys, inclusive of selenium arsenic, selenium tellurium, selenium arsenic tellurium; selenium with halogens therein; and halogen doped selenium alloys. Also, positively charged toners can be selected for the development of images present on layered photoresponsive devices, reference U.S. Pat. No. 4,265,990, the disclosure of which is totally incorporated herein by reference.

The following examples are being supplied to further define specific embodiments of the present invention, it being noted that these examples are intended to illustrate and not limit the scope of the present invention. Parts and percentages are by weight unless otherwise indicated.

EXAMPLE I

A toner composition was prepared by blending in a Banbury rubber mill, followed by micronization, 70 percent by weight of a styrene butadiene resin, commercially available from Goodyear as Pliolite; 20 percent by weight of a polypropylene wax available as Viscol 550P; and 10 percent by weight of the pigment Heliogen Blue L, a metal-free phthalocyanine available from BASF. The toner also included blended therein 0.2 percent by weight of the flow aid additive Aerosil R972, which additive can also be added subsequent to heat spheroidization.

There results toner particles with a particle size diameter of from about 8 to about 12 microns.

Thereafter, the above prepared toner is introduced into a Bowen 30 inch spray dryer by means of a suitable powder feeder at a feed rate of 10 grams per minute. The inlet temperature of the spray dryer was maintained at 600° F. Subsequent to the aforementioned heat spheroidization, there results toner particles of a spherical shape which are free flowing, each of which are encapsulated in a 0.25 micron thick continuous shell of the polypropylene wax as evidenced by transmission electron microscopy (TEM).

A positively charged toner, 25 microns per gram, can also be prepared by incorporating therein, in place of the Aerosil, aluminum oxide.

EXAMPLE II

Toner compositions were prepared by repeating the procedure of Example I with the exception that there was selected 10 percent by weight of Hostaperm Pink, available from American Hoechst, in place of the 10 percent by weight of Heliogen Blue L; and 0.5 percent by weight of Aerosil R972 in place of the 0.2 percent by weight of Aerosil R972. There resulted toner particles with a continuous encapsulating shell of the polypropylene wax.

EXAMPLE III

A toner composition was prepared by repeating the procedure of Example I with the exception that there was selected in place of the 550P polpropylene wax, Bareco E-2020 wax. There resulted toner particles encapsulated with a continuous shell of the E-2020 wax.

EXAMPLE IV

A toner composition was prepared by repeating the procedure of Example I with the exception that there was selected in place of the 550P polypropylene wax, Bareco Polywax 1000. There resulted toner particles encapsulated within a continuous shell of the 1000 wax.

EXAMPLE V

A toner composition was prepared by repeating the procedure of Example I with the exception that there was selected in place of the Heliogen Blue L, American Hoechst Permanent Yellow FGL. There resulted toner particles encapsulated in a continuous shell of the 550P polypropylene wax.

EXAMPLE VI

Developer compositions were then prepared by admixing 1.2 grams of the toner compositions obtained in Example II with 60 grams of carrier particles consisting of a ferrite core, with 0.6 percent by weight of a styrene, methylmethacrylate, triethoxy silane terpolymer coating, and 20 percent by weight of Vulcan carbon black. Admixing was accomplished in a small jar followed by blending in a roll mill for 15 minutes. A sample of each of the developers was then selected and the triboelectric charge on the toner, which was about −40 microcoulombs per gram in each instance, was measured by the known Faraday cage process utilizing a blow-off process. Subsequently, the developers were roll milled for 24 hours, and the triboelectric charge for each of the toners was again determined. Additionally, there were prepared two developer compositions by repeating the above procedure with the toners of Example II with the exception that a heat spheroidization step was not accomplished. Thus, the wax remained in the bulk of the toner particles rather than being present as a continuous encapsulating shell. The triboelectric charge on these developers was also determined in accordance with the aforementioned procedure.

The following data was then generated in an aging test fixture, reference FIG. 1, which is a plot of the tribo product versus the time in hours for these four developer compositions. Specifically, lines 1 and 2 represent the tribo product of the developer prepared without heat spheroidization; styrene butadiene, 70 percent by weight; 10 percent by weight of Hostaperm Pink; line 2, 10 percent by weight of Sudan Blue; and 70 percent by weight of styrene butadiene.

Lines 3, Hostaperm Pink, and 4, Sudan Blue, represent the tribo product of developer compositions as prepared in accordance with Example II, and wherein heat spheroidization of the toner in each instance was accomplished so as to result in an encapsulated continuous shell of the wax thereover.

A review of the aforementioned line graphs clearly reveals a relatively stable tribo product for the developer compositions of the present invention, reference lines 3 and 4, as compared to a an unstable tribo product for the developer compositions wherein the toners do not contain thereover a continuous shell of an encapsulating wax, reference lines 1 and 2.

In this graph the tribo product is calculated as the triboelectric charge on the toner in microcoulombs per gram multiplied by the toner concentration.

Moreover, the developer compositions with heat spheroidized toner as prepared in Example VI were incorporated into a Xerox Corporation 6500® apparatus, and there resulted colored images of excellent resolution, no background deposits, and stable aging characteristics for over 10,000 imaging cycles.

Other modifications of the present invention will occur to those skilled in the art based upon a reading of the present disclosure. These are intended to be included within the scope of this invention.

What is claimed is:

1. A process for preparing encapsulated toner particles which comprises blending together resin particles, colored pigment particles, and a waxy substance with a molecular weight of from about 500 to about 20,000, micronizing the resulting mixture to form toner sized particles, and permitting the waxy substance to form an encapsulating continuous shell on the surface of the toner particles by subjecting the formed particles to heat spheroidization.

2. A process according to claim 1 wherein the resin is selected from the group consisting of styrene acrylates, styrene methacrylates, and styrene butadiene polymers.

3. A process according to claim 2 wherein the styrene methacrylate is styrene/n-butyl methacrylate.

4. A process according to claim 1 wherein the pigment particles are selected from the group consisting of magenta, yellow, and cyan.

5. A process according to claim 1 wherein the pigment particles are present in an amount of from about 1 percent by weight to about 15 percent by weight.

6. A process according to claim 1 wherein the molecular weight of the waxy substance is less than about 6,000.

7. A process according to claim 1 wherein the waxy substance is selected form the group consisting of polyethylenes and polypropylenes.

8. A process according to claim 7 wherein the molecular weight of the polyethylene is less than about 6,000.

9. A process according to claim 7 wherein the molecular weight of the polypropylene is less than about 6,000.

10. A process according to claim 1 wherein the continuous shell is of a thickness of from about 0.25 micron to about 1.0 micron.

11. A process according to claim 1 wherein the waxy substance is present in an amount of from about 1 percent by weight to about 30 percent by weight.

12. A process according to claim 1 wherein colloidal silica additive particles are blended together with the resin particles, colored pigment particles, and waxy substance.

13. A process according to claim 1 wherein fatty acid metal salt additive particles are blended together with the resin particles, colored pigment particles, and waxy substance.

14. A process according to claim 1 wherein the heat spheroidization is effected at a temperature of about 600° F.

15. A process according to claim 1 wherein the heat spheroidization is effected by introducing the toner particles into a spray dryer by means of a powder feeder.

16. A process according to claim 1 wherein the toner particles are introduced into the spray dryer at a feed rate of about 10 grams per minute.

17. A process according to claim 1 wherein the resulting encapsulated toner particles are spherical in shape and free flowing.

18. A process for preparing an electrophotographic developer which comprises:

a. preparing encapsulated toner particles by blending together resin particles, colored pigment particles, and a waxy substance with a molecular weight of from about 500 to about 20,000, micronizing the resulting mixture to form toner sized particles, and permitting the waxy substance to form an encapsulating continuous shell on the surface of the toner particles by subjecting the formed particles to heat spheroidization; and b. admixing the encapsulated toner particles with carrier particles.

19. A process according to claim 18 wherein the toner particles are present in an amount of about 1 part by weight and the carrier particles are present in an amount of from about 3 parts by weight to about 200 parts by weight.

20. A process according to claim 18 wherein the carrier particles comprise a steel core with a coating thereover.

21. A process according to claim 20 wherein the coating comprises a fluoropolymer resin.

22. A process according to claim 18 wherein the carrier particles comprise a ferrite core coated with a styrene, methylmethacrylate, triethoxy silane terpolymer coating containing carbon black particles.

23. A process according to claim 18 wherein the toner particles and carrier particles are admixed by blending in a roll mill for about 15 minutes.

24. A process according to claim 18 wherein the resulting developer exhibits a toner triboelectric product of from about negative or positive 30 to about negative or positive 90.

* * * * *